US005284080A

United States Patent [19]

Noguchi et al.

[11] Patent Number: 5,284,080

[45] Date of Patent: Feb. 8, 1994

[54] TONE GENERATING APPARATUS UTILIZING PREPROGRAMMED FADE-IN AND FADE-OUT CHARACTERISTICS

[75] Inventors: Atsushi Noguchi; Yasushi Sato, both of Hamamatsu, Japan

[73] Assignee: Kabushiki Kaisha Kawai Gakki Seisakusho, Japan

[21] Appl. No.: 693,450

[22] Filed: Apr. 29, 1991

[30] Foreign Application Priority Data

May 2, 1990 [JP] Japan ..... 2-115258

[51] Int. Cl.[5] ..... G10H 7/00; G10H 1/04

[52] U.S. Cl. ..... 84/604; 84/624

[58] Field of Search ..... 84/601, 602, 604, 606, 84/607, 608, 623, 624, 661

[56] References Cited

U.S. PATENT DOCUMENTS

| | | | |
|---|---|---|---|
| 4,348,929 | 9/1982 | Gallitzendörfer | 84/607 |
| 4,520,708 | 6/1985 | Wachi | 84/607 |
| 4,635,520 | 1/1987 | Mitsumi | 84/607 |
| 4,679,480 | 7/1987 | Suzuki | 84/DIG. 9 |
| 4,738,179 | 4/1988 | Hideo | 84/604 |
| 4,763,553 | 8/1988 | Nagai et al. | 84/604 |
| 5,074,181 | 12/1991 | Kitamura | 84/607 |
| 5,086,475 | 2/1992 | Kutaragi et al. | 84/603 X |
| 5,086,685 | 2/1992 | Hanzawa et al. | 84/602 X |
| 5,094,136 | 3/1992 | Kudo et al. | 84/603 |
| 5,111,727 | 5/1992 | Rossum | 84/603 |

*Primary Examiner*—William M. Shoop, Jr.
*Assistant Examiner*—Jeffrey W. Donels
*Attorney, Agent, or Firm*—Bruce I. Adams; Van C. Wilks

[57] ABSTRACT

A tone generating apparatus comprises a wave memory for consecutively storing first tone wave data acquired by performing pulse code modulation on a tone waveform in a first predetermined interval starting at an attack of a musical tone, second tone wave data provided by adding that tone wave data which is obtained by performing pulse code modulation on a tone waveform in a second predetermined interval following the first predetermined interval and is then weighted with a fade-out characteristic and that tone wave data which is acquired by synthesizing waveform components of a tone waveform in a third predetermined interval following the second predetermined interval and is then weighted with a face in-characteristic after being linked for the second predetermined interval, and third tone wave data produced by synthesizing waveform components of a tone waveform in a third predetermined interval following the second predetermined interval based on a characteristic of the tone waveform in the third predetermined interval. The first tone wave data, the second tone wave data and the third tone wave data are read out once in the named order from the wave memory, and then the third tone wave data is repeatedly read out, thereby generating a tone signal.

32 Claims, 8 Drawing Sheets

TONE GENERATING APPARATUS UTILIZING PREPROGRAMMED FADE-IN AND FADE-OUT CHARACTERISTICS

BACKGROUND OF THE INVENTION

1. Field of the Invention

The present invention relates to a tone generating apparatus for use in an electronic keyboard, electronic piano, synthesizer and so forth. More particularly, this invention pertains to a tone generating apparatus which generates musical tones by repeatedly reading out tone wave data stored in advance in a memory.

2. Description of the Related Art

There is a tone generating apparatus which sequentially reads out tone wave data from a wave memory and puts the data through tone generation or tone-ON processing to thereby generate musical tones.

Such a conventional tone generating apparatus is designed such that tone wave data corresponding to every waveform from the rise or attack portion of a musical tone to the end or release portion thereof is stored in advance in the wave memory and these pieces of tone wave data are sequentially read out from the beginning to prepare an associated tone signal, thus providing a continuous or sustaining musical tone.

The tone generating apparatus employing this system, however, requires a great amount of memory capacity to store the tone wave data, and inevitably become expensive.

As a solution to this shortcoming, there is a tone generating apparatus which has a wave memory to store in advance tone wave data corresponding a multiple-period waveform of a predetermined interval starting at the attack portion of a musical tone, reads the tone wave data from the beginning of the predetermined interval to the end thereof, and, after reading out the last piece of the tone wave data, repeatedly reads out tone wave data of a given interval at the end portion of the predetermined interval, thereby providing a sustaining musical tone. (The given interval will be hereinafter called "repetitive reading interval.")

According to this type of a tone generating apparatus, however, at the time wave data of the repetitive reading interval is repeatedly read out, it is difficult to accurately read out the wave data continuously in a given period, and discontinuity may occur at the repeated portion. The occurrence of such a discontinuous portion would make the continuity of a musical tone unnatural and would generate many unnecessary harmonic overtones even if the tone has a sinusoidal waveform, resulting in generation of low-quality musical tones.

SUMMARY OF THE INVENTION

It is therefore an object of the present invention to provide a tone generating apparatus which will not cause discontinuity in the repetitive portion of a waveform of a given period in a repetitive reading interval even when repeatedly reading the waveform in the repetitive reading interval, so that the continuity of an associated musical tone becomes natural and generation of unnecessary harmonic overtones can even be prevented, thus ensuring generation of high-quality musical tones.

To achieve this object, a tone generating apparatus according to the present invention comprises a wave memory for consecutively storing first tone wave data acquired by modulating a tone waveform in a first predetermined interval starting at an attack of a musical tone, second tone wave data acquired by subjecting tone wave data, obtained by modulating a tone waveform in a second predetermined interval following the first predetermined interval, to a predetermined process, and third tone wave data produced by synthesizing waveform components of a tone waveform in a third predetermined interval following the second predetermined interval based on a characteristic of the tone waveform in the third predetermined interval; and a tone generator for reading out the first tone wave data, the second tone wave data and the third tone wave data once in a named order from the wave memory, and then repeatedly reading out the third tone wave data to thereby generate a tone signal.

According to the present invention, tone wave data acquired by modulating a waveform in a first predetermined interval corresponding to an attack portion of an original musical tone is stored directly as first tone wave data. Tone wave data, obtained by modulating a waveform of the original musical tone in a second predetermined interval following the attack portion of the musical tone and weighted with a fade-out characteristic, and synthesized wave data of a single period acquired by synthesizing waveform components of the original musical tone in an arbitrary third predetermined interval after the second predetermined interval, and weighted with a fade-in characteristic after being linked for the second predetermined interval, are added together or subjected to so-called cross-fade mixing. The added wave data is stored as second tone wave data. As third tone wave data is stored wave data of a single period which is acquired by synthesizing waveform components of the original musical tone in the third predetermined interval.

In generating a musical tone, the first tone wave data and second tone wave data are consecutively read out once, followed by repetitive readout of the third tone wave data, thereby generating a sustaining musical tone.

Accordingly, transition from the attack portion of a musical tone to the repetitively reading portion becomes smoother, and since the wave data to be repeatedly read out is synthesized wave data, no discontinuity occurs in the musical tone. Therefore, the musical tone will sound natural and no unnecessary harmonic overtones will be produced, thus ensuring generation of high-quality musical tones.

DETAILED DESCRIPTION OF THE PREFERRED EMBODIMENT

A preferred embodiment of the present invention will now be described referring to the accompanying drawings.

Figure 1:
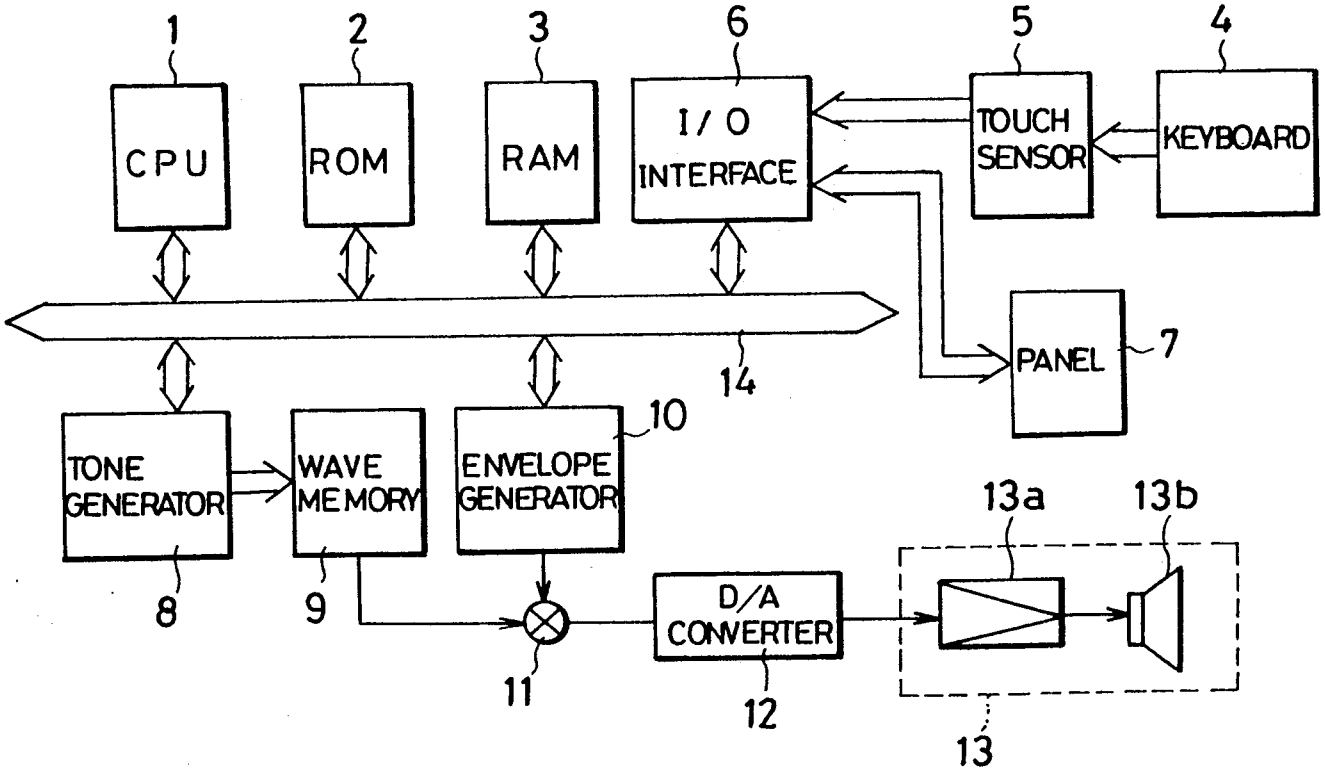
FIG. 1 is a block diagram illustrating the structure of the essential portions of an electronic musical instrument to which a tone generating apparatus of the present invention is applied.

FIG. 1 is a block diagram illustrating the structure of the essential portions of an electronic musical instrument to which a tone generating apparatus according to the present invention is applied.

A central processing unit (hereafter referred to as "CPU") 1 controls the individual sections of this electronic musical instrument. To realize the control, the CPU 1 sequentially reads a program stored in a program memory section in a read only memory (hereafter referred to as "ROM") 2 via a system bus 14, and interprets and runs it command by command.

The contents of the ROM 2 include not only a program to operate the CPU 1 but also timbre data and other various fixed data.

Predetermined data stored in the ROM 2 is transferred to a random access memory (hereafter referred to as "RAM") 3 and is stored there. Various registers and a work area are defined in the RAM 3 to control the electronic musical instrument.

A keyboard 4 has multiple keys which transmit the key depression or key release done by a player. A switch, which is activated or deactivated interlockingly with each key on the keyboard 4 is attached to that key. An open/close signal of the switch interlocking with the associated key on the keyboard 4 is to be sent to a touch sensor 5.

The touch sensor 5 detects a key code indicating a depressed or released key and touch data representing the force of key depression. This touch sensor 5 is well known as a touch detector. The key code and touch data detected by the touch sensor 5 are to be supplied to an input/output (I/O) interface 6.

A panel 7 includes a power switch, a mode designate switch, a timbre select switch, a rhythm select switch and various effect switches. A panel scanner (not shown) detects how these switches on the panel 7 are set. The statuses of the switches detected by the panel scanner are each encoded and supplied as a panel switch code to the I/O interface 6.

The I/O interface 6 receives the key code of the depressed or released key, the touch data and the panel switch code from the panel 7, and supplies those to the CPU 1 through the system bus 14.

A tone generator 8 executes various types of control to generate a tone signal. For example, the tone generator 8 reads wave data, piece by piece, which corresponds to a timbre selected by the timbre select switch of the panel 7 and the key code of the depressed or released key on the keyboard 4, from a wave memory 9, and controls the generation of a sustaining tone signal. The detailed structure and operation of the tone generator 8 will be described later.

The wave memory 9 stores multiple pieces of wave data each corresponding to a timbre or a pitch. The wave memory 9 receives data output from the tone generator 8 as an address, and outputs one piece of wave data from the addressed location. The wave data read from the wave memory 9 is sent as a digital tone wave signal to a multiplier 11. The tone wave data to be stored in the wave memory 9 will be described later in detail.

An envelope generator 10 generates an envelope signal for controlling the amplitude of a tone wave signal, in accordance with envelope data sent through the system bus 14. The envelope signal generated by the envelope generator 10 is also supplied to the multiplier 11.

The multiplier 11 multiplies a digital tone wave signal from the wave memory 9 by an envelope signal from the envelope generator 10, generating a digital tone signal added with an envelope added, i.e., a tone signal with a controlled dynamic level. The envelope-added digital tone signal is to be sent to a D/A converter 12.

The D/A converter 12 converts a digital tone signal from the multiplier 11 into an analog tone signal, and supplies it to a sound system 13.

The sound system 13, comprising an amplifier 13*a* and a loudspeaker or a headphone 13*b*, converts the analog tone signal, received as an electronic signal from the D/A converter 12, into an acoustic signal.

Figure 3:
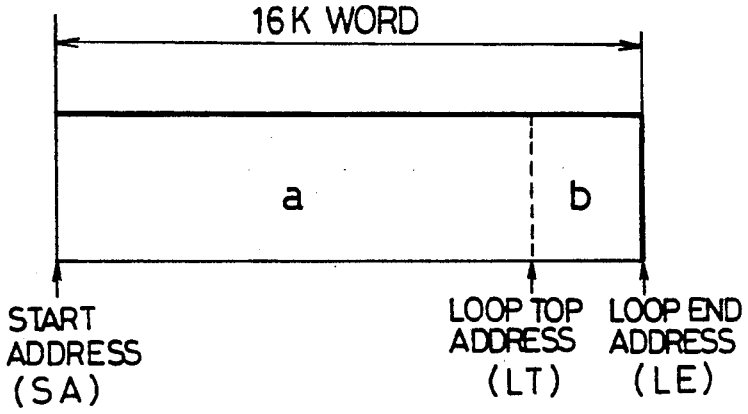
FIG. 3 is a diagram illustrating a storage format of a wave memory according to the embodiment of the present invention.

FIG. 3 is a diagram for explaining how the tone wave data of one timbre is stored in the wave memory 9.

Tone wave data corresponding to a predetermined timbre, consisting of, for example, a 16K word, has an attack portion a and a repetitive portion b of a musical tone.

The attack portion a and the repetitive portion b are consecutively stored in the wave memory 9; the attack portion a is stored between a start address SA and an address immediately before a loop top address LT, while the repetitive portion b is stored between the loop top address LT and a loop end address LE.

Here, the start address SA is the head address at which the tone wave data is stored. The loop top address LT is the head address where repetitive data reading starts, and the loop end address LE is the end address for the repetitive data reading.

To generate one sustaining musical tone in accordance with a depressed key on the keyboard 4, reading the tone wave data starts from the start address SA, continuing through the loop top address LT up to the loop end address LE, and the reading is then repeated again from the loop top address LT. Thereafter, the tone wave data between the loop top address LT and the loop end address LE is repetitively read out to generate a sustaining musical tone.

Figure 4:
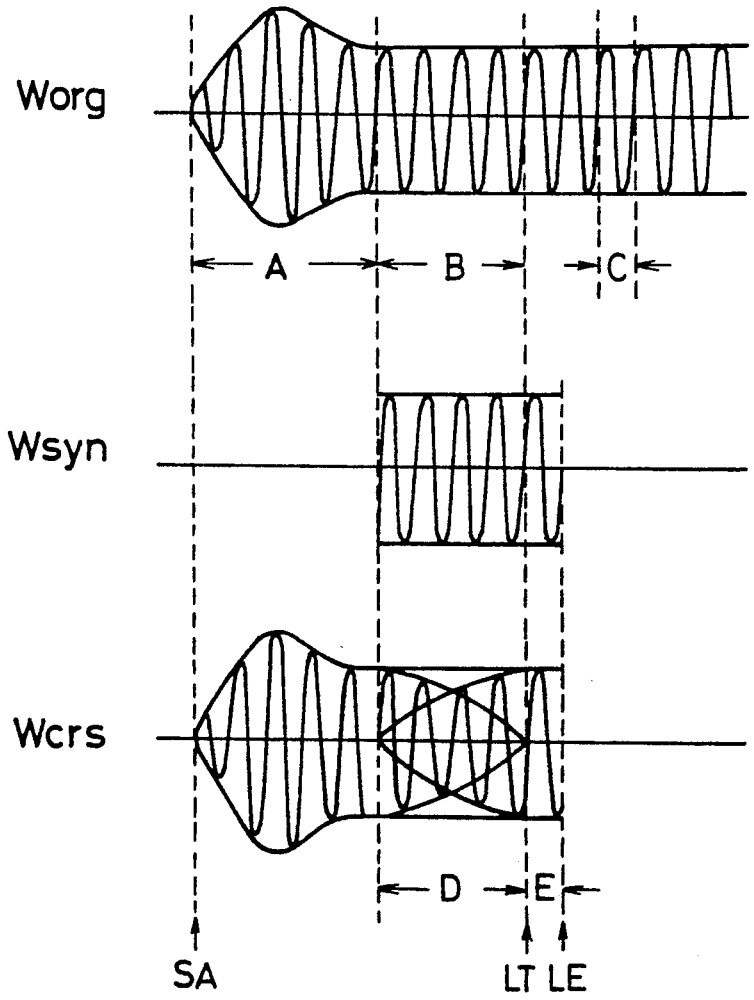
FIG. 4 is a diagram for explaining procedures to prepare tone wave data which is stored in the wave memory according to the embodiment of the present invention.

FIG. 4 is a diagram for explaining how to store tone wave data in the wave memory 9, a feature of the present invention. The tone wave data is to be stored in the format shown in FIG. 3.

An original tone wave Worg as shown in FIG. 4 is subjected to pulse code modulation and the resultant PCM data is fetched. Then an interval A (first predetermined interval) or the attack portion of tone wave, and an interval B (second predetermined interval) or the sustaining tone portion following the interval A are arbitrarily determined. An arbitrary interval C (third predetermined interval) following the interval B is then determined, and a frequency response (overtone level data) in the interval C is acquired through an FFT (fast Fourier transform), for example. Waveform components are synthesized based on the data acquired in the above-described manner, and the synthesized waveforms are linked together to yield a synthesized waveform Wsyn as shown in FIG. 4.

The wave data in the interval B is weighted with an attenuating characteristic, i.e, a fade-out characteristic while synthesized wave data Wsyn in the same interval as the interval B is weighted with an attack characteristic, i.e., a fade-in characteristic. At this time, the basic pitch of the original tone wave should be equal to that of the synthesized wave. These two pieces of the weighted wave data are added together, thus providing a so-called cross-fade mixed waveform Wcrs shown in FIG. 4.

In the wave memory 9 are sequentially stored the attack portion A of the original tone wave as the first tone wave data, a waveform (interval D) as the second tone wave data, which is acquired by cross-fade mixing subjecting the interval B of the original tone wave and the synthesized wave to cross-fade mixing, and one period (interval E) of a unweighted synthesized wave as the third tone wave data. These pieces of data form tone wave data for one timbre. The head of the interval A is the start address SA, the head of the interval E is the loop top address LT, and the end of the interval E is the loop end address LE. The start address SA, the loop top address LT and the loop end address LE, determined in this manner, are to be stored as information indicating the tone wave data in the ROM 2.

As the tone wave data prepared as described above is sequentially read out, the attack portion of the tone wave (interval A) is first generated, then transition to the generation of the synthesized wave portion is smoothly conducted because of the cross-fade portion (interval D), and finally one period of the unweighted synthesized wave is repeatedly read out, thus providing a natural sustaining musical tone.

Figure 2:
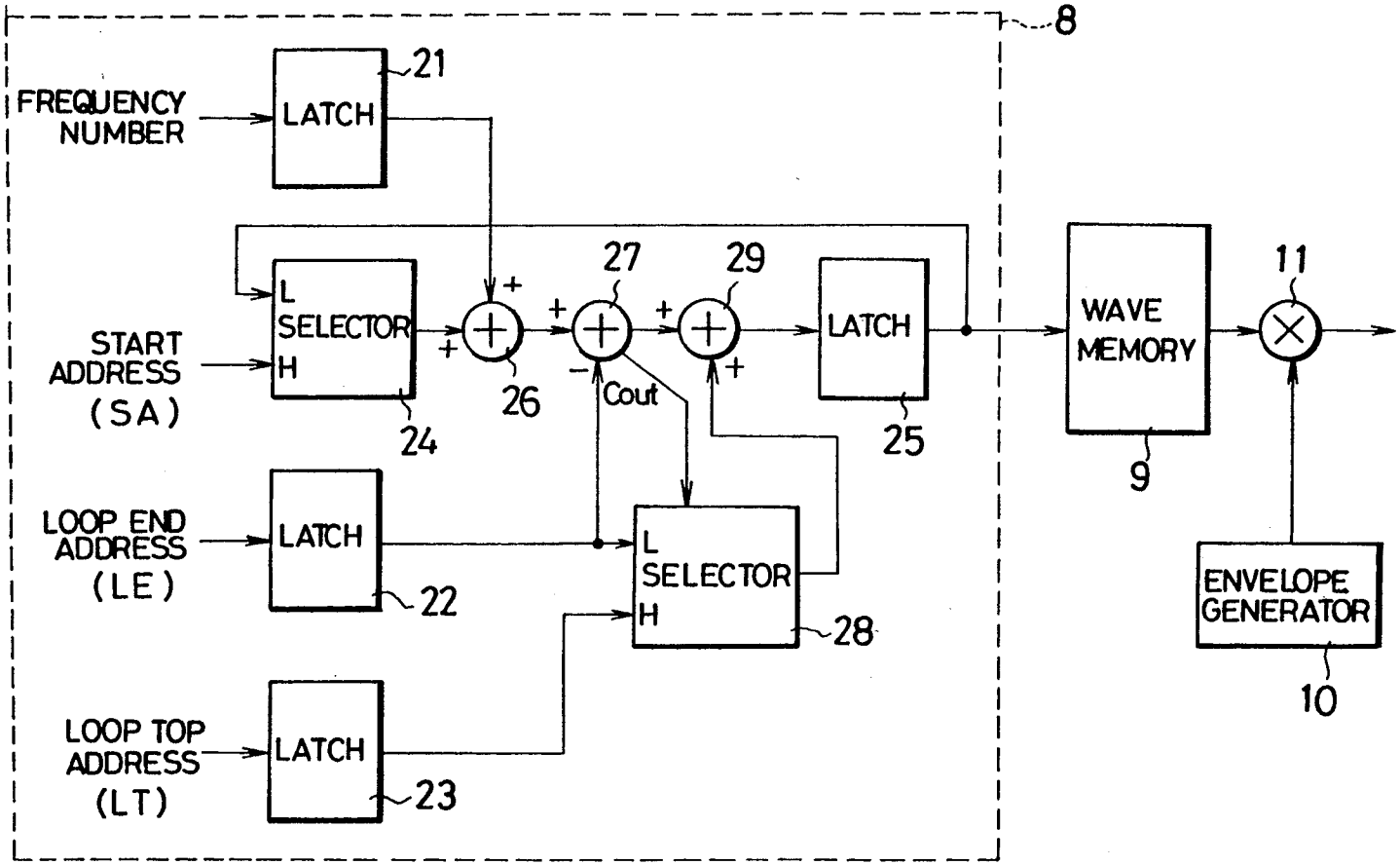
FIG. 2 is a detailed block diagram illustrating the structure of a tone generator shown in FIG. 1.

FIG. 2 is a block diagram illustrating one embodiment of the tone generator 8. The frequency number, the start address SA, the loop top address LT and the loop end address LE, are information sent from the CPU 1.

A latch 21 temporarily stores the frequency number which is determined according to a key code from the keyboard 4. Likewise, latches 22 and 23 temporarily store the loop top address LT and the loop end address LE, respectively.

A selector 24 selectively outputs either the start address SA or the output of a latch 25 to be described later. At the time tone generation starts, the selector 24 selects a side H in response to a control signal from a controller (not shown), and therefore outputs the start address SA.

An adder 26 adds the frequency number stored in the latch 21 to the output of the selector 24; the result of the addition will finally be a read address for the wave memory 9. The output of the adder 26 is supplied to an adder 27.

The adder 27 subtracts the loop end address LE stored in the latch 22 from the addition result from the adder 26 (or adds the complement of "2" to the addition result from the adder 26). A carry-out signal Cout output a the result of the operation done by the adder 27 is used to determine whether or not the read address has exceeded the loop end address LE.

When the read address ≦ the loop end address LE, the carry-out signal Cout becomes inactive; when the read address > the loop end address LE, the carry-out signal Cout becomes active.

In accordance with the carry-out signal Cout, a selector 28 selects either the loop end address LE stored in the latch 22 or the loop top address LT stored in the latch 23, and supplies it to an adder 29. This selector 28 selects the input on a side L (the loop end address LE) when the carry-out signal Cout is inactive, and selects the input on a side H (the loop top address LT) when the carry-out signal Cout is active.

The adder 29 adds the output of the adder 27 to the output of the selector 28, and supplies the result to the latch 25.

The latch 25 temporarily stores the output from the adder 29. The output of the latch 25 is used as an address for reading tone wave data from the wave memory 9. The output from the latch 25 is sent to the input terminal on the side L of the selector 24 to be used to calculate the next read address.

In other words, the selector 24, the adder 26 and the latch 25 realize the function of an accumulator. The adders 27 and 29 and the selector 28 realize the function for shifting the read address around from the loop end address LE to the loop top address LT.

The operation of the tone generator 8 with the above structure will now be described.

The CPU 1 sets the frequency number in the latch 21, the loop end address LE in the latch 22, and the loop top address LT in the latch 23. At the initial status, the side H of the selector 24 is selected in response to the control signal from the controller (not shown).

Under these circumstances, when the start address SA is sent to the selector 24, the adder 26 adds the frequency number to the start address SA in the first time slot, and sends the result as a read address to the adder 27.

The adder 27 then subtracts the loop end address LE stored in the latch 22 from the read address sent from the adder 26. If the output of the adder 26 (read address) has not exceeded the loop end address LE, the carry-out signal Cout does not become active. The selector 28 therefore selects the side L, permitting the loop end address LE to be supplied to the adder 29.

The adder 29 adds the output of the adder 27 to the output of the selector 28 (loop end address LE), which means adding what has been subtracted by the adder 27 again. The adder 29 therefore provides the same output as the adder 26. This output from the adder 29 is set as the read address for the wave memory 9 in the latch 25.

From the next time slot on, the selector 24 is controlled so as to select the side L. By executing the same operation as described above, the frequency number is added to the current read address, yielding the next read address, which is in turn supplied to the wave memory 9.

When the read address is calculated one by one in the above-described manner, and exceeds the loop end address LE, i.e., when the carry-out signal from the adder 27 becomes active, the selector 28 selects the side H. As a result, the adder 29 receives the loop top address LT at one input terminal, and the output of the adder 27 at the other input terminal. The output of the adder 27 indicates how much the read address has exceeded the loop end address LE. When the output of the adder 27 is added to the output of the selector 28, the read address becomes the loop top address LT (in the case where the output of the adder 27 is "0"), or a value resulting from compensation for the amount exceeding from the loop end address LE (in the case where the output of the adder 27 is larger than "0").

By repeatedly executing the above operation, the tone wave data will be repeatedly read out from the wave memory 9, and a sustaining musical tone corresponding to the key code will be generated.

The characteristic of the tone wave acquired in the case where the present invention is used will now be explained in comparison with the tone wave acquired in the case where the present invention is not used.

Figure 8:
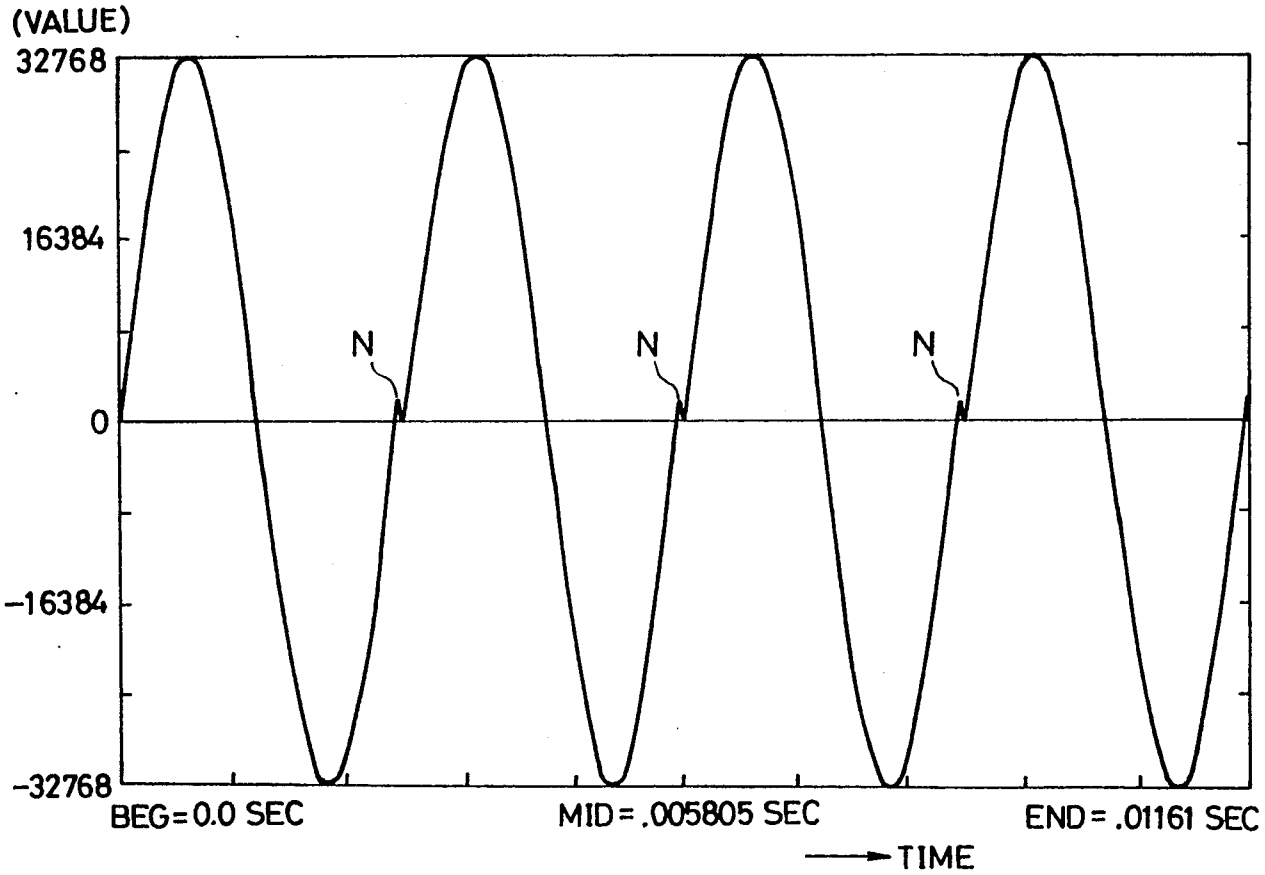
FIG. 8 is a graph exemplifying a tone waveform acquired by a tone generating apparatus to which the present invention is not applied.

FIG. 8 exemplifies a waveform pattern in the case where the repetitive portion is a sinusoidal wave of one period which is consecutively read out so as to generate a sustaining musical tone, without using the present invention.

Figure 9:
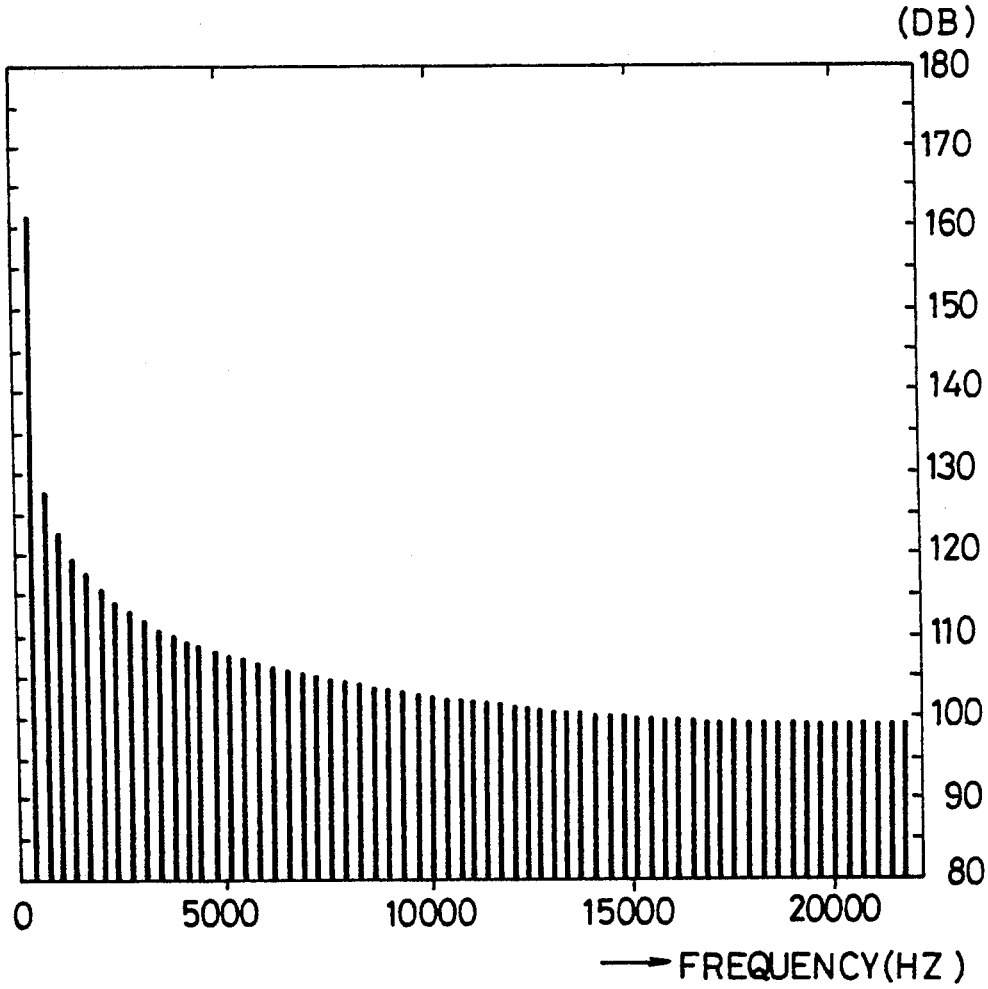
FIG. 9 is a graph of the frequency response of the tone waveform shown in FIG. 8.

At the time wave data in a specific interval at the end portion, it is difficult to accurately and continuously read the wave data in a given period. Therefore, a discontinuous portion N occurs at the repetitive portion as illustrated. Once such a discontinuous portion N occurs, the continuity of a musical tone becomes unnatural and many unnecessary harmonic overtones are generated even if the tone has a sinusoidal waveform, as indicated by the frequency response given in FIG. 9. This hinders high-quality musical tones from being generated.

Figure 5:
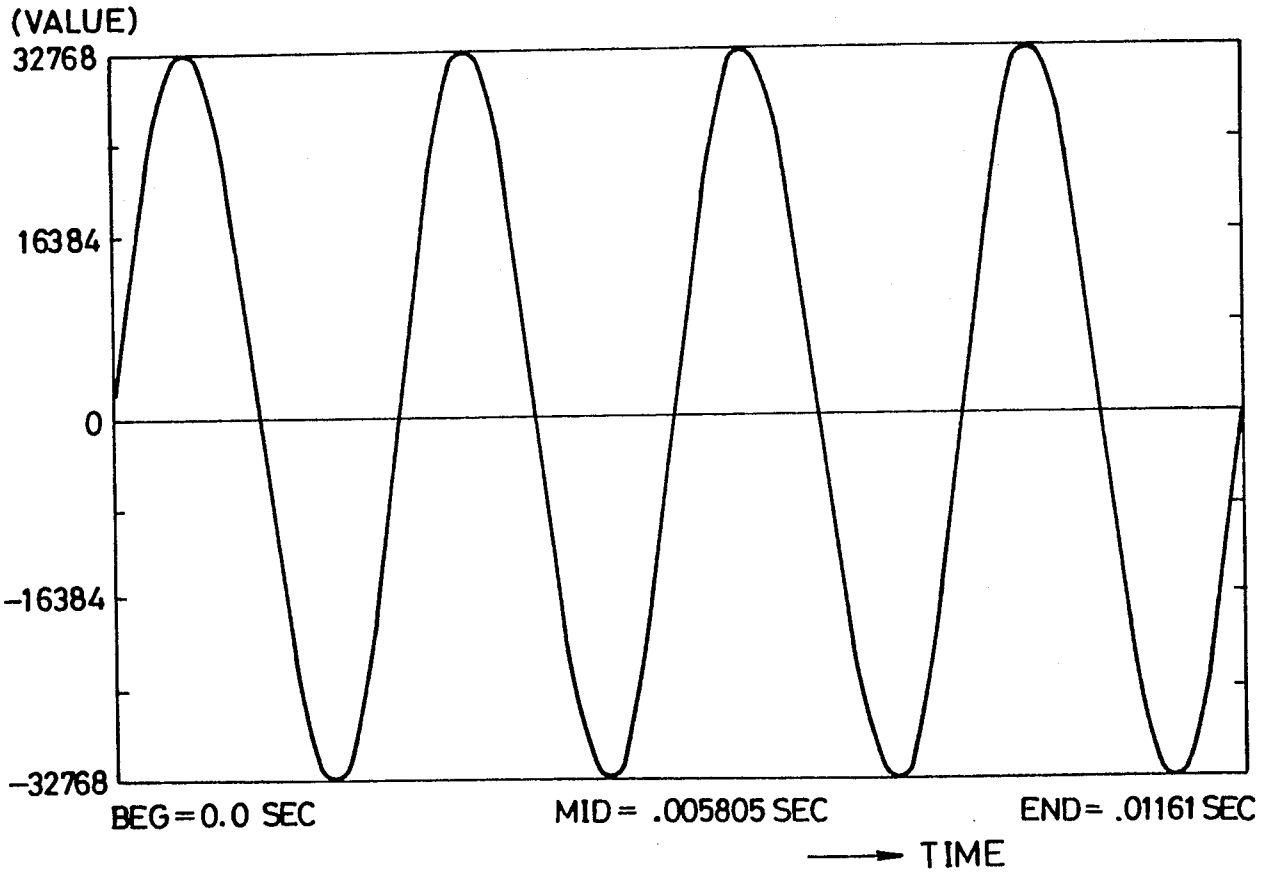
FIG. 5 is a diagram exemplifying a tone waveform acquired according to the present invention.

FIG. 5, on the other hand, illustrates a wave pattern in the case where the repetitive portion (portion between the loop top address LT and the loop end address LE), as a one-period sinusoidal wave, is continuously read out to thereby generate a sustaining musical waveform. As apparent from the drawing, the tone wave is a smooth sinusoidal wave without any discontinuous portion.

Figure 6:
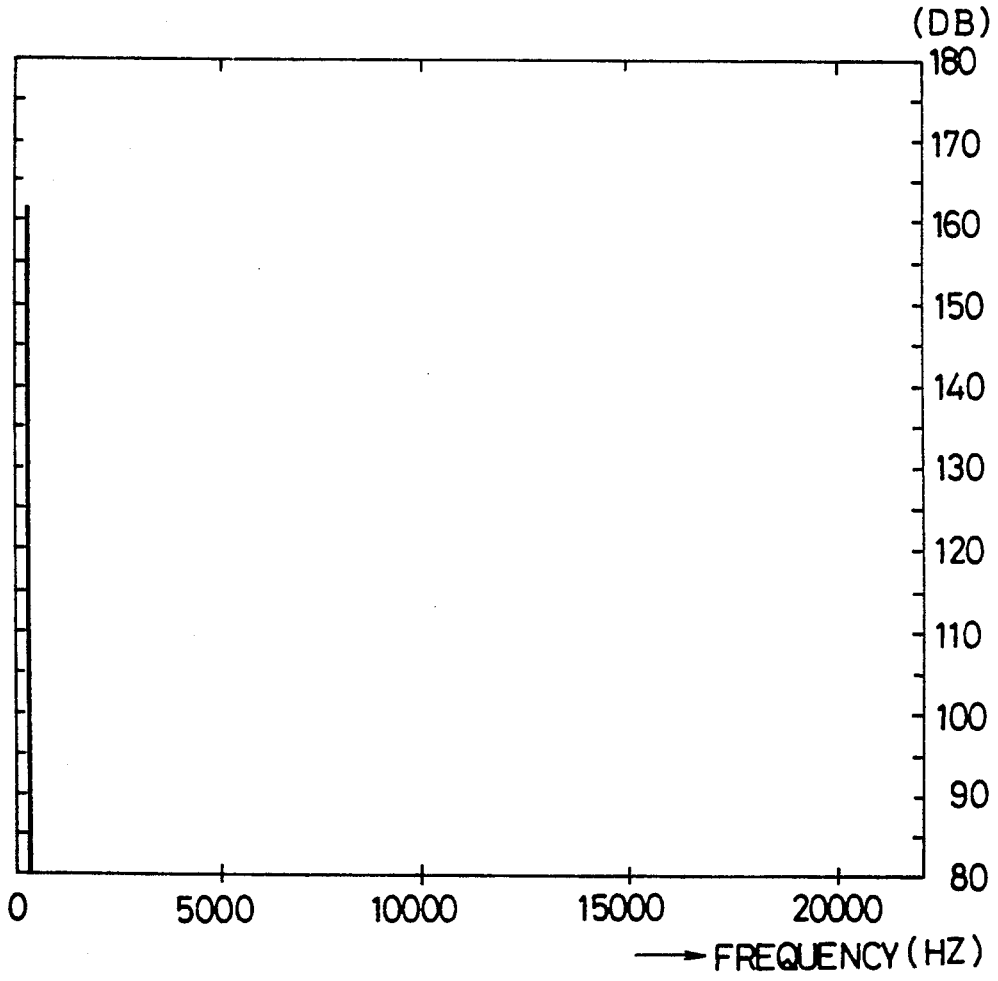
FIG. 6 is a graph illustrating the frequency response of the tone waveform shown in FIG. 5.

FIG. 6 illustrates the frequency response of the tone wave shown in FIG. 5. With this response, unnecessary harmonic overtones do not occur, making it possible to provide a high-quality musical tone.

Figure 7:
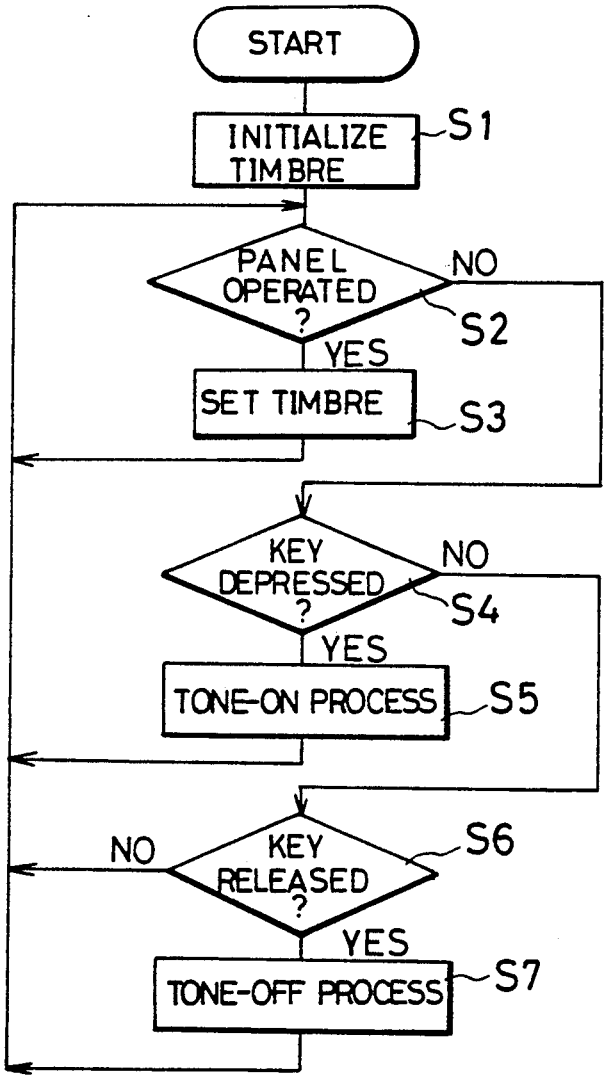
FIG. 7 is a flowchart for explaining the operation of an electronic musical instrument.

The operation of an electronic musical instrument shown in FIG. 1 will be described below referring to the flowchart illustrated in FIG. 7.

When the operation starts upon power on, initialization of a timbre is executed (step S1). In other words, a timbre pointer which designates a timbre to be generated is initialized, and initial timbre data stored in a timbre table designated by this timbre pointer in the ROM 2 is sent to the tone generator 8.

The CPU 1 receives a panel switch code from the panel 7 through the I/O interface 6 and determines whether any switch of the panel 7 has been operated (step S2). When the CPU 1 judges that some switch of the panel 7 has been operated, the CPU 1 sets a timbre pointer in the timbre table according to how the switch has been operated (step S3). Then, the timbre data designated by the timbre pointer is supplied to the tone generator 8, and is then sent as an address to the wave memory 9. As a result, the corresponding tone wave data of the timbre is read from the wave memory 9.

When the CPU 1 judges that no switch of the panel 7 has been operated, the CPU 1 fetches data from the keyboard 4 through the I/O interface 6 and checks if any key has been depressed (step S4). When the CPU 1 judges that a key depression has occurred, a tone-ON process is performed (step 5). The tone-ON process is to transfer data according to the timbre, touch data and tone range to the tone generator 8 and the envelope generator 10 and instruct to start tone generation. Accordingly, a tone signal is generated through the above-described operation, and a musical tone is released from the sound system 13.

When the CPU 1 determines in step S4 that no key has been depressed, the CPU 1 fetches data from the keyboard 4 through the I/O interface 6 and checks if any key has been released (step S6). When the CPU 1 judges that there is a key release, a tone-OFF process is performed (step S7). The tone-OFF process is to transfer data according to the timbre, touch data and tone range to the tone generator 8 and the envelope generator 10 and instruct to terminate tone generation. This terminates the generation of a tone signal, and thus stops releasing of musical tones from the sound system 13. At this time, tone releasing is not completely stopped, but reverberation remains in accordance with the key release.

When the above sequence of processes is terminated, the flow returns to step S2 to repeatedly execute the above-described operation. Therefore, tone generation or stopping the tone generation will be executed while changing the timbre in accordance with the operation of the switches of the panel 7, and depression or releasing of the keys on the keyboard 4.

According to the present invention as described above in detail, even when the wave data of a predetermined period in a given interval at the end portion is repeatedly read out from the wave memory, no discontinuous portion occurs at the repetitive portion. It is therefore possible to provide a tone generating apparatus, which can make the linkage of musical tones natural, and prevent the occurrence of unnecessary harmonic overtones, thus ensuring generation of high-quality musical tones.

What is claimed is:

1. A tone generating apparatus comprising:

a pre-programmed wave memory having pre-programmed and stored therein for each timbre first tone wave data acquired by modulating a tone waveform in a first predetermined interval starting at an attack of a musical tone, second tone wave data acquired by subjecting tone wave data, obtained by modulating a tone a waveform in a second predetermined interval following said first predetermined interval, to a predetermined process, wherein the first and second tone wave data are stored between a start address and a loop top address, and third tone wave data produced by synthesizing waveform components of a tone waveform in a third predetermined interval following said second predetermined interval based on a characteristic of said tone waveform in said third predetermined interval, wherein the third tone wave data is stored between the loop top address and a loop end address;

a tone generator for reading out said pre-programmed first tone wave data, said pre-programmed second tone wave data and said pre-programmed third tone wave data once in a named order from the start address to the loop end address in said wave memory, and then repeatedly reading out said third pre-programmed tone wave data between the loop top address and the loop end address;

means for generating a tone signal directly from the read out pre-programmed tone wave data; and wherein said second tone wave data pre-programmed in said wave memory is prepared by adding that tone wave data which is acquired by subjecting said tone waveform in said second predetermined interval to pulse code modulation and is then weighted with a fade-out characteristic, and that tone wave data which is acquired by synthesizing waveform components of said tone waveform in said third predetermined interval based on a characteristic of said tone waveform in said third predetermined interval and is then weighted with a fade-in characteristic after being linked for said second predetermined interval.

2. A tone generating apparatus according to claim 1, wherein modulation for producing said first or second tone wave data pre-programmed in said wave memory in pulse code modulation.

3. A tone generating apparatus according to claim 1, wherein synthesis for providing said third tone wave data pre-programmed in said wave memory is executed based on a frequency response acquired by fast Fourier transform of a tone waveform in said third predetermined interval.

4. A tone generating apparatus according to claim 1, wherein said third tone wave data pre-programmed in said wave memory is tone wave data of a single period.

5. A tone generating apparatus comprising:

a wave memory having pre-programmed and stored therein for each timbre first tone wave data acquired by modulating a tone waveform in a first predetermined interval starting at an attack of a musical tone, second tone wave data acquired by subjecting tone wave data, obtained by modulating a tone waveform in a second predetermined interval following said first predetermined interval, to a predetermined process, wherein the first and second tone wave data are stored between a start address and a loop top address, and third tone wave data produced by synthesizing waveform components of a tone waveform in a third predetermined interval following said second predetermined interval based on a characteristic of said tone waveform in said third predetermined interval, wherein the third tone wave data is stored between the loop top address and a loop end address;

a tone generator for reading out said pre-programmed first tone wave data, said pre-programmed second tone wave data and said pre-programmed third tone wave data once in a named order from the start address to the loop end address in said wave memory, and then repeatedly reading out said third pre-programmed tone wave data between the loop top address and the loop end address;

means for generating a tone signal directly from the read out pre-programmed tone wave data; and wherein said second tone wave data pre-programmed in said wave memory is prepared by performing an arithmetic operation on tone wave data, acquired by subjecting said tone waveform in said second predetermined interval to pulse code modulation, and tone wave data, acquired by synthesizing waveform components of said tone waveform in said third predetermined interval based on a characteristic of said tone waveform in said third predetermined interval.

6. A method of preparing tone wave data, comprising the steps of:

modulating a tone waveform in a first predetermined interval from an attack of a musical tone to provide first tone wave data;

performing a predetermined process on tone wave data, acquired by modulating a tone waveform of said musical tone in a second predetermined interval following said first predetermined interval, thereby providing second tone wave data;

synthesizing waveform components of a tone waveform in a third predetermined interval following said second predetermined interval based on a characteristic of said tone waveform in said third predetermined interval, thereby providing third tone wave data;

pre-programming said first tone wave data, said second tone wave data and said third tone wave data for each timbre in a wave memory wherein the first and second tone wave data are stored between a start address and a loop top address and wherein the third tone wave data is stored between the loop top address and a loop end address; and wherein said second tone wave data is prepared by adding that tone wave data which is acquired by subjecting said tone waveform in said second predetermined interval to pulse code modulation and is then weighted with a fade-out characteristic, and that tone wave data which is acquired by synthesizing waveform components of said tone waveform in said third predetermined interval based on a characteristic of said tone waveform in said third predetermined interval and is then weighted with a fade-in characteristic after being linked for said second predetermined interval.

7. A method according to claim 6, wherein the step of modulating to produce said first or second tone wave data is pulse code modulation.

8. A method according to claim 6, wherein the step of synthesizing comprises acquiring a frequency response by fast Fourier transform of said tone waveform in said third predetermined interval.

9. A method according to claim 6, wherein said third tone wave data is tone wave data of a single period.

10. A tone wave generating method, comprising the steps of:

a. producing first tone wave data from a first predetermined interval of a tone waveform corresponding to the attack of a musical tone;

b. producing tone wave data from a second predetermined interval of the tone waveform which follows said first predetermined interval and from a third predetermined interval of the tone waveform which follows the second predetermined interval;

c. producing synthesized waveform data from the tone wave data from steps a and b;

d. producing second tone wave data from the synthesized waveform data and the tone wave data from the second predetermined interval by weighting the synthesized waveform data with a fade-in characteristic, weighting the tone wave data from the second interval with a fade-out characteristic and combining same to produce cross-fade mixed waveform data;

e. producing third tone wave data from the synthesized waveform data;

f. pre-programming the first, second and third tone wave data for each timbre in a wave memory, wherein the first and second tone wave data are stored between a start address and a loop top address and wherein the third tone wave data is stored between the loop top address and a loop end address; and g. generating a tone signal directly from the pre-programmed first tone wave data followed by the pre-programmed second tone wave data by reading out data from the start address to the loop top address and thereafter by at least one repetition of the pre-programmed third tone wave data by reading out data between the loop top address and the loop end address.

11. The method according to claim 10, wherein the steps of producing the tone wave data from the first and second intervals comprise pulse code modulating said musical tone in the first and second intervals.

12. The method according to claim 10, wherein the step of producing tone wave data from the synthesized waveform data comprises performing a fast Fourier transform on the synthesized waveform data.

13. The method according to claim 10, wherein the third tone wave data corresponds to a single period of the synthesized waveform data.

14. A tone wave generator, comprising:

a pre-programmed wave memory having for each timbre first tone wave data pre-programmed therein and representative of a first predetermined interval of a tone waveform corresponding to the attack of a musical tone, second tone wave data pre-programmed therein and representative of tone wave data from a second predetermined interval of the tone waveform which follows said first predetermined interval and from synthesized waveform data based on tone wave data from a third predetermined interval of the tone waveform which follows the second predetermined interval and from the tone wave data from the first and second intervals, wherein the first and second tone wave data are stored between a start address and a loop top address, and third tone wave data pre-programmed therein from the synthesized waveform data, wherein the third tone wave data is stored between the loop top address and a loop end address, wherein the second tone wave data comprises data produced from weighting the synthesized waveform data with a fade-in characteristic, weighting the tone wave data from the second interval with a fade-out characteristic and combining same to produce cross-fade mixed waveform data;

means for reading out the pre-programmed first tone wave data followed by the pre-programmed second tone wave data from the start address to the loop top address and thereafter by at least one repetition of the pre-programmed third tone wave data between the loop top address and the loop end address; and means for generating a tone signal directly from the read out data.

15. The generator according to claim 14, wherein the tone wave data from the first and second intervals comprises data produced from pulse code modulating said musical tone in the first and second intervals.

16. The generator according to claim 14, wherein the tone wave data from the third interval comprises data produced from a fast Fourier transform on the musical tone in the third interval.

17. The generator according to claim 14, wherein the third tone wave data corresponds to a single period of the synthesized waveform data.

18. A tone wave generating method, comprising:

producing first tone wave data representative of a first predetermined interval of a tone waveform corresponding to the attack of a musical tone;

producing second tone wave data representative of tone wave data from a second predetermined interval of the tone waveform which follows said first predetermined interval and from synthesized waveform data based on tone wave data from a third predetermined interval of the tone waveform which follows the second predetermined interval and from the tone wave data from the first and second intervals by weighting the synthesized waveform data with a fade-in characteristic, weighting the tone wave data from the second interval with a fade-out characteristic and combining same to produce cross-fade mixed waveform data;

producing third tone wave data from the synthesized waveform data;

pre-programming the first, second and third tone wave data for each timbre into a wave memory, wherein the first and second tone wave data are stored between a start address and a loop top address and wherein the third tone wave data is stored between the loop top address and a loop end address;

reading out the pre-programmed first tone wave data followed by the re-programmed second tone wave data from the start address to the loop top address and thereafter by at least one repetition of the pre-programmed third tone wave data between the loop top address and the loop end address; and generating a tone signal directly from the read out data.

19. A method according to claim 18, wherein the tone wave data from the first and second intervals is produced by pulse code modulating said musical tone in the first and second intervals.

20. A method according to claim 18, wherein the tone wave data from the third interval is produced by performing a fast Fourier transform on the musical tone in the third interval.

21. A method according to claim 18, wherein the third tone wave data corresponds to a single period of the synthesized waveform data.

22. A wave memory, comprising:

means defining a memory area having pre-programmed therein for each timbre first tone wave data acquired by modulating a tone waveform in a first predetermined interval starting at an attack of a musical tone, second tone wave data acquired by subjecting tone wave data, obtained by modulating a tone waveform in a second predetermined interval following said first predetermined interval, to a predetermined process, wherein the first and second tone wave data are stored between a start address and a loop top address, and third tone wave data produced by synthesizing waveform components of a tone waveform in a third predetermined interval following said second predetermined interval based on a characteristic of said tone waveform in said third predetermined interval, and wherein the third tone wave data is stored between the loop top address and a loop end address.

23. A wave memory according to claim 22; wherein said first or second tone wave data pre-programmed in said wave memory is obtained by pulse code modulation.

24. A wave memory according to claim 22; wherein said third tone wave data pre-programmed in said wave memory is synthesized based on a frequency response acquired by fast Fourier transform of a tone waveform in said third predetermined interval.

25. A wave memory according to claim 22; wherein said third tone wave data pre-programmed in said wave memory is tone wave data of a single period.

26. A wave memory according to claim 22; wherein said second tone wave data pre-programmed in said wave memory is prepared by adding that tone wave data which is acquired by subjecting said tone waveform in said second predetermined interval to pulse code modulation and which is then weighted with a fade-out characteristic, and that tone wave data which is acquired by synthesizing waveform components of said tone waveform in said third predetermined interval based on a characteristic of said tone waveform in said third predetermined interval and which is then weighted with a fade-in characteristic after being linked for said second predetermined interval.

27. A wave memory according to claim 22; wherein said second tone wave data pre-programmed in said wave memory is prepared by performing an arithmetic operation on tone wave data, acquired by subjecting said tone waveform in said second predetermined interval to pulse code modulation, and tone wave data, acquired by synthesizing waveform components of said tone waveform in said third predetermined interval based on a characteristic of said tone waveform in said third predetermined interval.

28. A wave memory, comprising:

means defining a memory area having first, second and third tone wave data pre-programmed therein for each timbre, the first tone wave data being representative of a first predetermined interval of a tone waveform corresponding to the attack of a musical tone, the second tone wave data being representative of tone wave data from a second predetermined interval of the tone waveform which follows said first predetermined interval and from synthesized waveform data based on tone wave data from a third predetermined interval of the tone waveform which follows the second predetermined interval and from the tone wave data from the first and second intervals, wherein the first and second tone wave data are stored between a start address and a loop top address, and the third tone wave data being synthesized waveform data, wherein the third tone wave data is stored between the loop top address and a loop end address.

29. A wave memory according to claim 28; wherein the tone wave data from the first and second intervals comprises data produced from pulse code modulating said musical tone in the first and second intervals.

30. A wave memory according to claim 28; wherein the tone wave data from the third interval comprises data produced from a fast Fourier transform on the musical tone in the third interval.

31. A wave memory according to claim 28; wherein the third tone wave data corresponds to a single period of the synthesized waveform data.

32. A wave memory according to claim 28; wherein the second tone wave data comprises data produced from weighting the synthesized waveform data with a fade-in characteristic, weighting the tone wave data from the second interval with a fade-out characteristic and combining same to produce cross-fade mixed waveform data.

* * * * *

UNITED STATES PATENT AND TRADEMARK OFFICE

CERTIFICATE OF CORRECTION

PATENT NO. : 5,284,080

DATED : February 8, 1994

INVENTOR(S) : Atsushi NOGUCHI et al.

It is certified that error appears in the above-indentified patent and that said Letters Patent is hereby corrected as shown below:

COLUMN 8

Line 42, delete "a", second occurrence.

COLUMN 9

Line 14, "in" should read --is--.

COLUMN 12

Line 28, "re-programmed" should read --pre-programmed--.

Signed and Sealed this

Twenty-first Day of March, 1995

*Attest:*

*Attesting Officer*

Bruce Lehman

BRUCE LEHMAN

*Commissioner of Patents and Trademarks*